US006663752B2

(12) United States Patent
Santilli

(10) Patent No.: US 6,663,752 B2
(45) Date of Patent: Dec. 16, 2003

(54) CLEAN BURNING LIQUID FUEL PRODUCED VIA A SELF-SUSTAINING PROCESSING OF LIQUID FEEDSTOCK

(75) Inventor: Ruggero Maria Santilli, Palm Harbor, FL (US)

(73) Assignee: Hadronic Press, Inc., Palm Harbor, FL (US)

( * ) Notice: Subject to any disclaimer, the term of this patent is extended or adjusted under 35 U.S.C. 154(b) by 279 days.

(21) Appl. No.: 09/970,405

(22) Filed: Oct. 3, 2001

(65) Prior Publication Data

US 2003/0133855 A1 Jul. 17, 2003

(51) Int. Cl.[7] ..... B01J 19/08; C10L 1/02

(52) U.S. Cl. ..... 204/164; 204/657; 204/168; 60/645; 60/646; 60/657; 60/670; 422/186.21; 422/186.22; 422/186.23; 422/186.26; 422/186.27; 44/628; 44/639

(58) Field of Search ..... 60/645, 646, 657, 60/670; 422/186.21, 186.22, 186.23, 186.26, 186.27; 204/164, 165, 168; 44/628, 639

(56) References Cited

U.S. PATENT DOCUMENTS 603,058 A * 4/1898 Eldridge et al. ..... 204/278
3,992,277 A * 11/1976 Trieschmann et al. ..... 204/172
4,566,961 A * 1/1986 Diaz et al. ..... 204/168
4,683,146 A * 7/1987 Hirai et al. ..... 427/583
5,026,484 A * 6/1991 Juvan ..... 210/717
5,069,765 A * 12/1991 Lewis ..... 204/173
5,159,900 A * 11/1992 Dammann ..... 123/3
5,343,699 A * 9/1994 McAlister ..... 60/273
5,417,817 A * 5/1995 Dammann et al. ..... 205/335
5,435,274 A * 7/1995 Richardson, Jr. ..... 123/3
5,692,459 A * 12/1997 Richardson, Jr. ..... 123/3
5,792,325 A * 8/1998 Richardson, Jr. ..... 204/164
5,826,548 A * 10/1998 Richardson, Jr. ..... 123/3
6,113,748 A * 9/2000 Richardson, Jr. ..... 204/170
6,153,058 A * 11/2000 Richardson, Jr. ..... 204/164
6,183,604 B1 * 2/2001 Santilli ..... 204/172
6,263,838 B1 * 7/2001 Richardson, Jr. ..... 123/3
6,299,656 B1 * 10/2001 Richardson, Jr. ..... 44/603
6,299,738 B1 * 10/2001 Richardson, Jr. ..... 204/164
6,314,918 B1 * 11/2001 McFarland et al. ..... 123/3
6,540,966 B1 * 4/2003 Santilli ..... 422/186.21
2002/0004022 A1 * 1/2002 Santilli ..... 422/186.04
2003/0051991 A1 * 3/2003 Santilli ..... 204/164
2003/0051992 A1 * 3/2003 Rappa et al. ..... 204/164
2003/0106787 A1 * 6/2003 Santilli ..... 204/164
2003/0113597 A1 * 6/2003 Santilli ..... 429/17

OTHER PUBLICATIONS

Ruggero Maria Santilli, Ph.D., Foundations of Hadronic Chemistry, Chapter 8 "The New Chemical Species of Magnecules".

* cited by examiner

*Primary Examiner*—Alan Diamond
(74) *Attorney, Agent, or Firm*—Dennis G. LaPointe; Mason Law, P.A.

(57) ABSTRACT

The invention relates to a novel self-sustaining method for the clean production of a clean burning liquid fuel called MagneFuel, which method is based, first, in the production of a combustible gas via submerged electric arcs between carbon-base electrodes from crude oil, oil-base, or water-base liquid waste and then passing the combustible gas via a high pressure pipe into a tower for the catalytic liquefaction, whereby the sum of the heat output in the production of the combustible gas and that for its catalytic liquefaction is sufficient for the process to be self-sustaining, that is, capable to produce its own electricity. It is emphasized that this abstract is provided to comply with the rules requiring an abstract that will allow a searcher or other reader to quickly ascertain the subject matter of the technical disclosure. It is submitted with the understanding that it will not be used to interpret or limit the scope of meaning of the claims.

21 Claims, 3 Drawing Sheets

Figure 1:
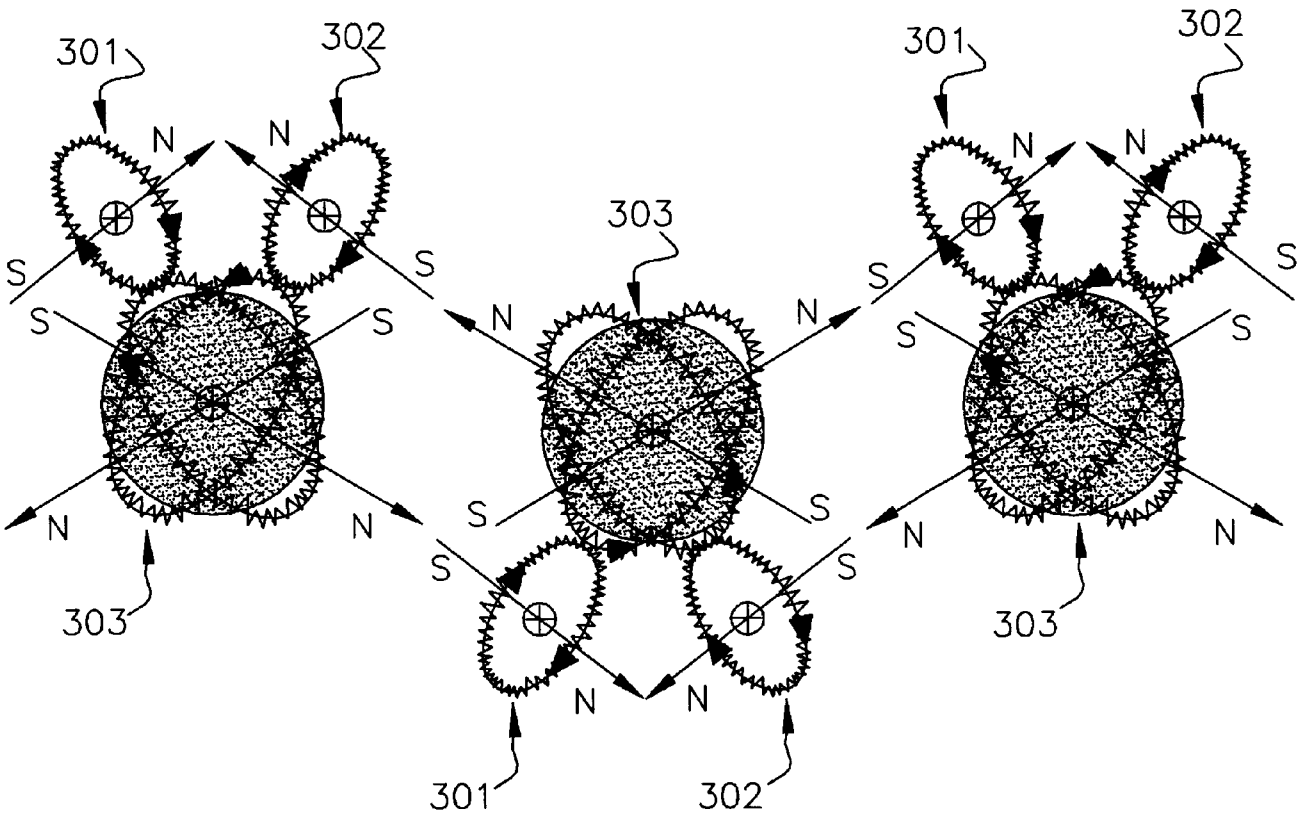

CLEAN BURNING LIQUID FUEL PRODUCED VIA A SELF-SUSTAINING PROCESSING OF LIQUID FEEDSTOCK

According to official data released by the U. S. Department of Energy, we have today a world-wide daily consumption of about 74 million barrels of crude oil, corresponding to a daily consumption of about 4 trillion gallons of gasoline, excluding the consumption of natural gas and coal. Such a disproportionate daily combustion of fossil fuels is causing serious environmental problems, such as:

1) The "green house effect" due to the emission of such a daily volume of $CO_2$, now estimated to be of about 30 million metric tons per day, which amount cannot any longer be processed by plants into oxygen and biomass, resulting in potentially catastrophic climactic events;
2) The "oxygen depletion" consisting of the permanent removal of breathable oxygen from our atmosphere, given by the $O_2$ in the $CO_2$ gas not recycled by plants, which oxygen depletion is now estimated to be of about 7 million metric tons per day, and is expected to cause heart failures particularly in densely populated urban environment; and
3) The largest emission of carcinogenic and other toxic substances in our planet, euphemistically called "atmospheric pollution," which is now estimated to be of the order of 5 million metric tons per day, which emission is expected to be the largest cause of cancer on Earth.

In the hope of contributing toward the future solution of these serious environmental problems, this invention deals with the discovery of a basically new liquid fuel, called "MagneFuel" for technical reasons outlined below, with the following main features: MagneFuel can be used as fuel in currently available automobiles; MagneFuel has an energy content similar to that of gasoline; the exhaust of MagneFuel combustion is dramatically cleaner than that of gasoline by surpassing the requirements of the Environmental Protection Agency (EPA) without catalytic converter; MagneFuel combustion dramatically reduces the use of atmospheric oxygen as occurring in gasoline combustion; MagneFuel combustion dramatically reduces the emission of carcinogenic or other toxic substance; MagneFuel is cost competitive with respect to fossil fuels; MagneFuel can be produced anywhere desired via the processing with equipment identified below of crude oil as well as virtually inextinguishable oil-base or water-base liquid wastes as feedstock; the process for the production of MagneFuel is self-sustaining, in the sense that it produces the electric energy needed for its own operation. As a result, MagneFuel is a significant replacement of gasoline.

A scientific notion which is fundamental for the above results is the new chemical species discovered by this inventor in 1998 and called for technical reasons "electromagnecules", as technically described in the monograph by R. M. Santilli entitled "Foundations of Hadronic Chemistry with Application to New Clean Energies and Fuels", Kluwer Academic Publisher, Boston/Dordrecht/London, in press ISBN number 1-4020-0087-1, see Chapter 8 in particular, which monograph is hereby incorporated by reference herein.

Electromagnecules are stable clusters of individual atoms (such as H. C and O), parts of molecules called dimers (such as OH and CH), and ordinary molecules (such as CO, and $H_2O$) bonded together by new internal attractive forces due to the electric and magnetic polarizations of the orbits of peripheral atomic electrons.

Electromagnecules in gases are well identified by clear macroscopic peaks in Gas Chromatographic Mass Spectrometers (GC-MS), which peaks remain unidentified by the computer search among all existing molecules, and have no InfraRed (IR) signature at their atomic weight, other than those of their smaller molecular constituents. These features establish that the clusters cannot possibly have a sole valence bond, thus constituting a new chemical species.

Electromagnecules in liquids are equally identified by large peaks in Liquid Chromatographic-Mass Spectrometers (LC-MS), which peaks also remain unidentified following computer search among all known liquid molecules, and have no UltraViolet (UV) signature at their atomic weight, features which again establish the novelty of the new chemical species.

The name "electromagnecules" was introduced by this inventor to distinguish the new species from the conventional molecules, as well as to denote that the new non-valence bonds are of both electric and magnetic character. The magnetic polarization is generally dominant over the electric polarization. However, on rigorous grounds both electric and magnetic contributions must be taken into account since nature teaches that one cannot occur without the other.

The name of "MagneFuel" is introduced as a short version of "ElectroMagneFuel" to denote that its chemical composition is given by liquid electromagnecules, rather than conventional molecules as occurring for gasoline, and it is given by individual atoms H, C and O, dimers OH, CH and C—O, and ordinary molecules such as $CH_2$, $H_2O$ and others (see below). For subsequent reference we recall that the C and O atoms admits three different types of conventional valence bonds, C—O which is hereinafter referred to as that with one single valence bond, C═O hereinafter referred to that with two valence bonds, and the conventional CO which is that with three valence bonds.

The availability within the structure of MagneFuel of isolated and unbounded atoms is of paramount importance for environmental aspects because these atoms recombine at the time of the combustion by releasing large amounts of energy. For instance, two H atoms, when they recombine into $H_2$, release 104 Kcal/mole, an amount of energy so large to power the known plasma cutters. Similarly, the production of CO at the time of combustion releases 255 Kcal/mole. As a result, the energy content of MagneFuel is bigger than that predicted by conventional thermochemistry and it is given by about the same energy content of gasoline, i.e., of the order of 110,000 British Thermal Units (BTU) per gallon (g), even though the chemical composition of MagneFuel is different than that of gasoline, as elaborated below.

Another important aspect is polymerization, a natural phenomenon according to which certain liquid molecules tend to aggregate themselves into a chain or a lattice, resulting in new physical and chemical properties generally absent for un-polymerized structures. When dealing with liquids with an electromagnecular structure, such a polymerization is enhanced and acquires a precise origin of the attractive force responsible for said aggregation.

With reference to FIG. 1, note that the ordinary $CH_2$═H—C—H molecule is similar to the water molecule $H_2O$═H—O—H, where "—" denotes valence bond. In both cases, the orbitals of the H—C or H—O dimers have a symmetry plane which is perpendicular to the plane of the molecule for various reasons known in chemistry. When these molecules are submitted to very strong external electric and magnetic fields, the orbitals acquire a toroidal configuration as technically described in Chapter 8 and Appendix 8A of the above mentioned monograph by this inventor. This results in the creation of the magnetic polarities North-South in the orbital of each valence electron as in FIG. 1. It is then easy to see that, since opposite magnetic polarities attract each other, polarized orbitals attract each other, resulting in chain of the type of FIG. 1, where 301 and 302 are polarized hydrogen atoms, 303 are polarized carbon atoms, and the chain is restricted to three H—C—H molecules for simplicity, with the understanding that the same chain can have an unrestricted length.

We should recall for completeness that the above chain of $CH_2$ molecules, also called methylene, when possessing a conventional molecular structure, constitute hydrocarbons. In particular, liquids with up to four $CH_2$ groups are generally referred to as light hydrocarbons; liquids with five to ten $CH_2$ groups constitute gasoline; chain containing from thirteen to seventeen $CH_2$ groups constitute diesel; bigger chains constitute paraffine (also called wax).

It should be stressed that, in reality, the polymerization of MagneFuel is dramatically more complex than that depicted in FIG. 1. This is due to the presence of unbounded polarized H, C and O atoms, as well as polarized dimers H—O and C—H, resulting in a form of polymerization of cluster-, rather than of chain-type. The latter feature has paramount importance for the environment because the latter clusters have the clear possibility of trapping in their interior unbounded atoms of oxygen. As more appropriately explained and illustrated below, MagneFuel can be rich in oxygen to such an extent to have a "positive oxygen balance" in the exhaust, namely, the oxygen emitted in the exhaust is bigger than that used for the combustion. As a result, this invention is particularly valuable in replenishing the oxygen now depleted by the indicated disproportionate combustion of fossil fuels.

The above cluster polymerization has the additional advantage of paramount importance for the environment of preventing the formation of heavy hydrocarbons, such as gasoline and diesel, while maintaining essentially the same energy content of the latter. In fact, said heavy hydrocarbons can only occur for polymerization including several groups, such as that for gasoline $C_5H_{10}{=}CH_2{-}CH_2{-}CH_2{-}CH_2{-}CH_2$. These chains are however precluded for an electromagnecular structure. In fact, by denoting with the symbol "×" the new polymer bonds due to magnetic polarization of the orbitals as depicted in FIG. 1, a cluster of MagneFuel with the same atoms as $C_5H_{10}$ can be $CH_2{\times}H{\times}CH_2{-}CH_2{\times}H{\times}CH_2{\times}C$. Under the additional presence of oxygen as an additive under a magnetic bond, the same cluster of MagneFuel can be of the type $O{\times}CH_2{\times}H{\times}CH_2{\times}O{\times}CH_2{\times}H{\times}CH_2{\times}O{\times}CH{\times}O$. By recalling the basic combustion reaction of methylene, $CH_2+3(O_2)\rightarrow CO_2+H_2O$, one can see that the presence of oxygen atoms in the chain dramatically reduces or eliminates the need for atmospheric oxygen during combustion.

More generally, a representative example of the electromagnecular clusters constituting MagneFuel contains not only isolated atoms of H, O and C, but also dimers OH and CH, as well as individual molecules CO and $CH_2$, and can be symbolically written $O{\times}CH{\times}H{\times}CO{\times}C{\times}CH_2{\times}OH{\times}CH_2{\times}H{\times}OH{\times}O{\times}CH{\times}O$ with the understanding that its distribution occurs in space as that of a cluster, rather than of a chain as occurring for gasoline. As a result, the polymerization process here considered acquires precisely the chemical structure of electromagnecules.

As one can see, the presence of individual atoms in the electromagnecular clusters of MagneFuel breaks the polymer chain, thus preventing the formation of heavy hydrocarbons. The same presence also enhances the energy output because, as indicated earlier, combustion breaks down electromagnecules, at which point isolated H atoms recombine into $H_2$ by releasing 104 Kcal/mole, while isolated C and C atoms recombine into CO with the release of 255 Kcal/mole. The latter feature explains a most important feature of this invention, namely, the achievement of a combustible liquid which does not possess the chemical structure of hydrocarbons, yet said liquid preserves the energy content of gasoline.

The combustion of MagneFuel is clean because it is given, in general, by about 50 water vapor, up to 15% breathable oxygen, up to 6% carbon dioxide, the rest being given by atmospheric gases. Therefore, MagneFuel can be used in any ordinary automobile in place of gasoline and such use will surpass EPA exhaust requirements without the use of a catalytic converter.

The above exhaust data are the result of various combustion processes. Note that fossil fuels are essentially composed of one basic molecule and, therefore, their combustion can be compared to the firing of a single state rocket with a single propellant. By comparison, MagneFuel is composed of several different combustible elements having different combustion speeds. Therefore, the combustion of MagneFuel can be compared to the firing of a multiple stage rocket each stage having different propellants.

In fact, following the breaking down of the electromagnecular clusters under combustion, we first have the recombination of H, O and C atoms into $H_2$, with the release of 104 Kcal/mole, $O_2$, with the release of 87 Kcal/mole, and CO, with the release of 255 Kcal/mole. We then have the known thermochemical reactions $H_2+O_2/2\rightarrow H_2O$ with the release of 57 Kcal/mole and $CO+O_2/2\rightarrow CO_2$ with the release of 67 Kcal/mole. We finally have the combustion of $CH_2$ which results in $CO_2$ plus water and the release of 180 Kcal/mole. The results of the combustion are then, again, $H_2O$ in vapor form originating from different reactions, $CO_2$, excess oxygen beyond that needed to create $CO_2$ and $H_2O$, and atmospheric gases.

As a result, MagneFuel dramatically reduces or resolves two of the potentially catastrophic environmental problems caused by fossil fuels recalled earlier, namely, the oxygen depletion and the emission of carcinogenic and toxic substances. Magnegas also implies a significant reduction of the green house effect because extensive tests and thermochemical calculations have established that the $CO_2$ emitted from the combustion of MagneFuel is about half that emitted by gasoline combustion for similar performances, such as the same distance by the same car under the same conditions for operations on gasoline and MagneFuel.

It should be indicated that there are conditions under which an excess of hydrogen in MagneFuel is preferable with respect to an excess of oxygen. This is the case, e.g., when MagneFuel is intended for use as rocket fuel. In this case the polymer clusters can also carry in their interior unbounded excess hydrogen in the desired amount which is released at the time of the combustion.

As more appropriately illustrated below, the main principles of this invention are the following: 1) initiate with the production of a combustible gas whose chemical composition is that of electromagnecules; 2) turn such a gas into a liquid via established methods of catalytic liquefaction; 3) introduce in the catalytic process additives to achieve the desired final liquid, e.g., to be oxygen or hydrogen rich; 4) treat the final liquid fuel for cooling, separation, filtration, additives, and other features and 5) use the well known large amount of heat released by said production of the combustible gas and catalytic liquefaction to power a turbine for the production of electric energy needed to power the production of the original gas.

STATION 1: PRODUCTION OF THE COMBUSTIBLE GAS WITH ELECTROMAGNECULAR STRUCTURE. According to extensive experimentations and studies reported in detail in the above-mentioned monograph by the inventor, in particular, Chapters 7 and 8, all combustible gases which are produced by underliquid electric arcs between carbon-base electrodes have indeed the desired electromagnecular structure.

Numerous methods exist for the production of the above type of combustible gases, such as the combustible gas disclosed in U.S. Pat. No. 603,058 to H. Eldridge, the combustible gas disclosed in U.S. Pat. Nos. 5,159,900 and 5,417,817 to W. A. Dammann and D. Wallman, respectively, the combustible gas disclosed in U.S. Pat. Nos. 5,435,274, 5,692,459, 5,792,325 to W. H. Richardson, Jr., the combustible gas disclosed in U.S. Pat. No. 6,183,604 to R. M. Santilli, and others.

Whatever the selected method for the production of the combustible gas, a condition is that said production occurs under high pressure, generally being 30 atmospheres (atm) as explained in the specifications below. This condition is needed not only to produce the combustible gas at the pressure needed to operate the catalytic liquefaction without the need of a pump, but also and most importantly to increase the efficiency for the maximization of the heat acquired by the original liquid feedstock, which heat is then used jointly with the heat produced by the catalytic liquefaction and the cooling station, to power an electric turbine for the self-generation of electricity.

STATION 2: CATALYTIC LIQUEFACTION. In 1902, P. Sabatier and J. D. Senderens were the first on record to produce methane from "water gas" which is a mixture of CO and $H_2$. In 1908, E. M. Orlov from Russia was the first on record to use Ni and Pd as catalysts for the synthesis of ethylene from water gas. In 1923, F. Fischer and H. Tropsch from Germany used Fe and Co as catalysts for the synthesis of alkanes (diesel) from water gas. In the second half of the 20-th century the process was used to convert natural gas into liquid fuels, wax and other substances. More recently, the process has regained attention because fuels produced with this method are much cleaners than fossil fuels. The process is at times referred to as the Orlov-Fisher-Tropsch synthesis, or just Fischer-Tropsch process. Hereinafter we shall simply refer to the process as "catalytic liquefaction." The related equipment is hereinafter called "catalytic liquefaction tower."

Some of the most important application of catalytic liquefaction are the following. The SASOIL company in South Africa operates a catalytic liquefaction tower which has produced over 700 million barrels of synthetic fuel since its start-up in the early 1980s. The SHELL company is operating a catalytic liquefaction tower in which synthetic gases are converted into liquid hydrocarbons, plus paraffine, and other substances. The RENTECH company in the U.S.A. operates a large catalytic liquefaction tower for the production of synthetic fuels and other substances. Numerous additional catalytic liquefaction towers are operated by various industries throughout the world.

The second station of this invention consists in discharging the combustible gas with electromagnecular structure produced in the first station into a catalytic liquefaction tower, which therefore converts it into a liquid fuel via the use of appropriate catalysts identified below, in such a way to preserve the electromagnecular structure in the transition from the gaseous to the liquid state. The latter feature is assured by the operating pressure of said tower of 30 atm.

Figure 2:
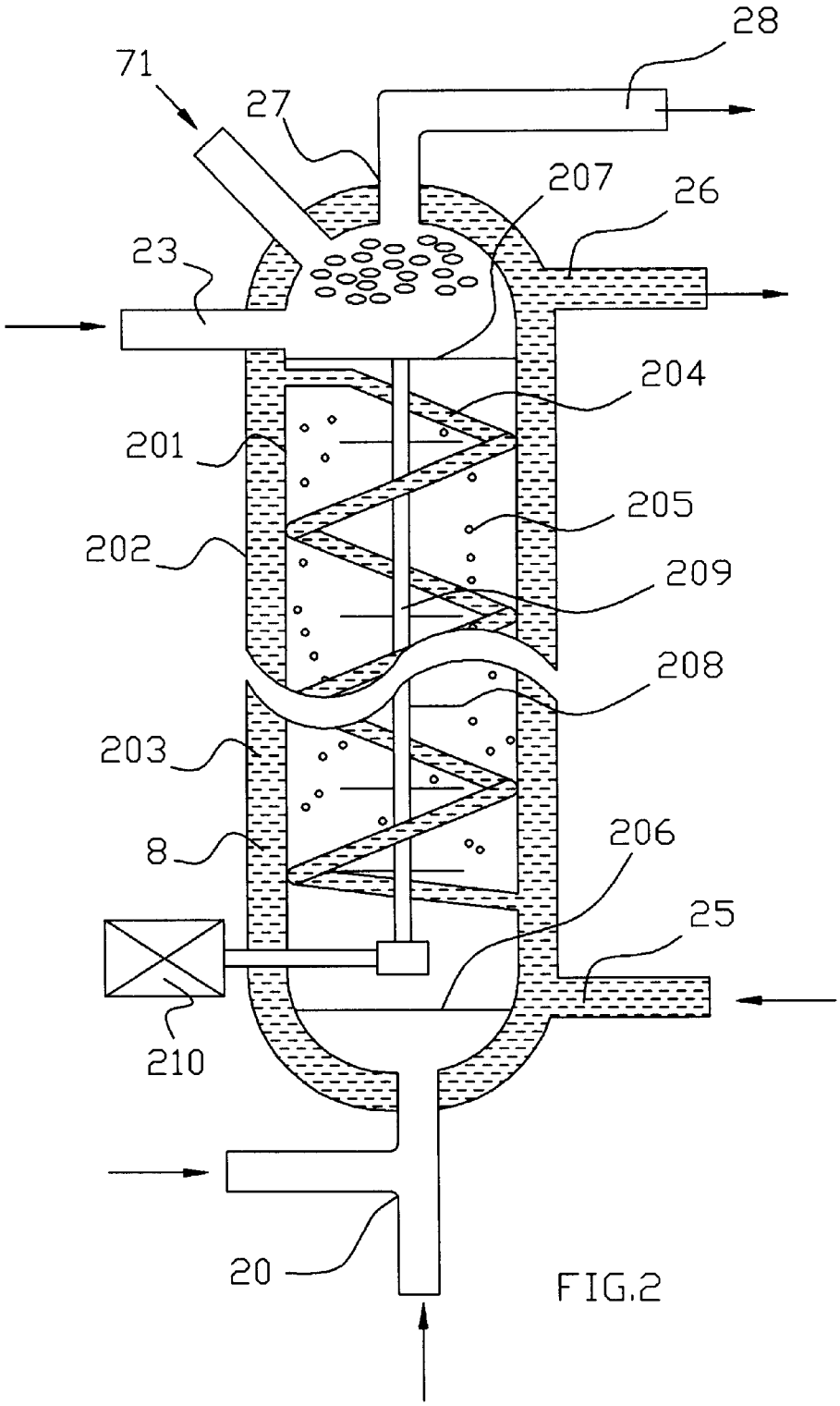

With reference to FIG. 2, and as particularly described in the specifications below, the catalytic liquefaction selected for this invention consists of a tower filled up with a catalyst in the form of a slurry. The combustible gas with electromagnecular structure is introduced from below at 30 atm pressure. Said gas then bubbles through the slurry at which point the catalysts perform the transition of state from gas to liquid with the joint release of a large amount of heat identified below. Because of such heat, the tower has to be cooled via a double, interconnected, internal and external cooling system operating at 240 degrees C., which generates steam at a temperature and pressure suitable to power a turbine. The fuel in vapor liquid form then leaves the tower from the top. In FIG. 2 the tower is cut in its central part to denote that its height is a multiple of its diameter as specified below. The slurry must be moved periodically to maintain the efficiency of the catalytic process. Finally, heavy oil and paraffine which may be produced as a by-product must be removed periodically from the slurry via flushing and other means.

STATION 3: ADDITIVE PROCESSES IN THE CATALYTIC LIQUEFACTION TOWER. As noted earlier, this invention can use any combustible gas with electromagnecular structure. However, these gases generally vary with the method used. For instance, when using submerged electric arcs between carbon electrodes within fresh water as feedstock, the combustible gas is essentially constituted by $H_2$ and CO with minor parts of $H_2O$, $CO_2$ and $O_2$ depending on the efficiency of the equipment. As such, the produced gas can be directly used in the catalytic liquefaction tower.

However, when oil-base feedstock is used, the latter have the generic structure $C_nH_{2n+2}$. The absence of oxygen in the feedstock then implies that the produced combustible gas is solely composed of the constituents of heavy hydrocarbons in an electromagnecular structure, resulting in a combustible fuel which is highly pollutant and positively not recommendable for actual use.

In the latter case, this invention is based on the addition to the catalytic process of the oxygen needed for the achievement of a clean burning MagneFuel. The latter can be added to the catalytic liquefaction tower in a variety of ways, such as, but not limiting to, the use of oxygen originating from the electrolytical separation of water via the excess electricity produced by the equipment, the addition of water, or other oxygen rich substances.

It should be indicated that, in the absence of the electromagnecular structure, the above environmental improvement of the final liquid fuel would be impossible. In fact, in the latter case we would have heavy hydrocarbon with conventional molecular structure which would not necessarily react with oxygen to produce the desired final result. On the contrary, when the combustible gas produced from oxygen-deficient oil-base feedstock has an electromagnecular structure, the catalytic reactions for the liquefaction of the gas do indeed permit the achievement of the desired clean liquid fuel.

This is due to the fact that, in the latter case, the chemical composition of the combustible gas is primarily composed by large clusters of isolated atoms of H and C and dimers CH with a minority of their percentage being conventional molecules of heavy hydrocarbon. Under these conditions, when combined to the missing oxygen in the catalytic liquefaction tower, the isolated atoms of H and C are ready to mix with O to produced the desired final liquid fuel. At worse, a small percentage of heavy hydrocarbon in the final liquid fuel can be separated via various known techniques, e.g., centrifuge.

It should also be noted that the electromagnecular structure of the original gas also permits the production of a final liquid fuel with the desired features, such as an excess of oxygen or of hydrogen, the first case being recommendable to regenerate the oxygen depleted by fossil fuel combustion, the second case being recommendable in other applications, e.g., as rocket fuel.

In fact, the electromagnecular structure of the final liquid fuel permits the embedding of unbounded oxygen or hydrogen atoms within the electromagnecular clusters, a feature that would be manifestly impossible for conventional molecular structure of the liquid fuel.

STATION 4: PROCESSING OF THE FINAL LIQUID FUEL. As indicated earlier, this invention requires the processing of the final clean burning liquid fuel, which processing consists of: cryogenic or other forms of cooling; separating; filtering; and processing as needed with additives.

As well known, catalytic towers produce a liquid at the vapor state, since it is at 240 degrees C. As a result, a first task of this final station is that of cooling down said vapor, resulting in a third source of heat, in addition to that originating from the production of the combustible gas and that in its liquefaction.

Moreover, the catalytic liquefaction generally produces a variety of polymerization clusters which have to be separated in order to reach the desired final fuel. This separation can be achieved in a variety of means. The first means is that based on temperature. In fact, the MagneFuel boiling temperature is of about 150 to 180 degrees C. Therefore, when cooling down the vapor released by the catalytic tower at 240 degrees C., liquid MagneFuel will first be produced. The resulting liquid at lower temperature is generally constituted by heavy hydrocarbons.

An alternative method is that of cooling down to ambient temperature the entire vapor produced by the catalytic liquefaction tower, and then separate MagneFuel from heavy hydrocarbon via a centrifuge.

Yet another method could be that of filtering MagneFuel from the rest of the vapor produced by the catalytic tower via the use of suitable filters. In the latter case MagneFuel can be composed of those magnecular clusters with a pre-set size. Alternatively, MagneFuel obtained via one of the preceding methods can be subjected to filtering to eliminate undesired particulates or magnecular clusters of excessive size.

This station can also be used for additives, e.g., for the production of MagneFuel for race uses with additive increasing octanes, or other additives increasing the energy content, and yet other additives decreasing the production of $CO_2$ during combustion. More generally, MagneFuel can be treated with essentially all additives currently available for gasoline. These additives are not individually identified here for brevity, because well known and commercially available.

It should be finally noted that the process of this invention releases nothing in the environment. In fact, all heavy hydrocarbons and other waste produced by this station can be added to the liquid feedstock used for the production of the combustible gas. Since the process of this invention is completely sealed without any release of combustible gas or vapor in the environment, and since the final waste is recycled into the feedstock for the production of the combustible gas, the process of this invention removes from the environment unwanted liquid waste, and solely releases the clean burning liquid MagneFuel.

STATION 5: SELF-GENERATION OF ELECTRICITY. Another well known property of catalytic liquefaction towers whose knowledge is herein assumed, is that they produce such an amount of heat to permit the generation of electricity, as industrially done by SASOL, SHELL, and RENTECH corporations mentioned earlier.

The physical origin of the heat is evidently due to the transition of state from gas to liquid which mandates the emission in the form of heat in the amount of energy required for the inverse process, the transition from liquid to gas. In fact, catalytic liquefaction towers have to be cooled down via internal and external heat exchangers to avoid their melt-down.

A first source of heat occurs in the catalytic process as explained below. In addition to the above free source of heat energy, and as also well known, the thermochemical reactions occurred in the production of combustible gases with electromagnecular structure constitute a second source of heat acquired by the liquid feedstock. This second type of heat is also so large that said liquid feedstock too has to be cooled-down via internal and external heat exchangers to avoid the melt-down of the equipment. A third source of heat is generated in the cooling of the MagneFuel vapor.

This invention is therefore based on the joint use of the heat originating in the production of the combustible gas, that originated in the liquefaction of the same gas and that generated in the cooling of the vapor. These two sources of heat are used for the production of steam usable to power a turbine electric generator. For instance, ordinary fresh water initially at ambient temperature can be used first to cool down the reactor for the production of the combustible gas, which reactor generally operates at about 120 degrees C., namely, at a temperature above the water boiling point. The latter boiling water can be then passed via high pressure pipes to cool down the catalytic liquefaction tower, which generally operate at about 240 degrees C., namely, at more than double the boiling temperature of water, by reaching in this way steam at such a temperature and pressure to power a turbine.

It should be noted that the above indicated sources of heat can produce more than sufficient electricity to operate the electric arc, the excess electricity can then be utilized in a variety of ways, such as its release to the grid, its use for the electrolytic separation of water, and other ways.

It should be noted that this invention can also use seawater as coolant, rather than ordinary fresh water, in which case this invention provides new means for desalting seawater. In fact, following its powering of a turbine, said steam can be cooled down and processed into drinkable water plus solid precipitates.

The heat produced by the process of this invention can be evaluated as follows. Extensive tests have established that one gallon of MagneFuel has approximately the same energy content of one gallon of gasoline, namely, 110,000 BTU/g. As well known, the change of state from gas to liquids for perfect gases occurs in the ratio 1,800 to 1, namely, 1,800 units of volumes of the gas are converted into one unit of liquid. Since the combustible gas with electromagnecular structure is not a perfect gas, the transition of state from gas to liquid occurs in this case in the ratio of about 1,500 to 1. As a result, it takes approximately 1,100 scf of the combustible gas to produce one gallon of liquid MagneFuel. By assuming that, in the average, the combustible gas with electromagnecular structure has an energy content of about 700 BTU/scf, 1,100 scf of combustible gas contain a total of about 770,000 BTU which yield a liquid with 110,000 BTU. The excess energy of 660,000 BTU/g= 600 BTU/scf is evidently released as heat in a combination of heat acquired by the catalytic liquefaction tower and heat resulting in the cooling down of the vapor.

Additionally, the production of the combustible gas via an underliquid DC electric arc between carbon-base electrodes within a liquid feedstock constitutes a second source of heat. As indicated earlier, the resulting gas is conventionally constituted of about 50% $H_2$ and 50% CO. As such, the creation of $H_2$ releases 104 Kcal/mole, while the creation of CO releases 255 Kcal/mole. These energy releases are evidently acquired by the liquid feedstock under the form of heat. Extensive tests have confirmed these expectations and established that the production of the combustible gas at about 30 atm generates heat at the rate of about 300 BTU/scf. As a result, the process of this invention implies the production of about 900 BTU/scf of heat, as the sum of 300 BTU/scf in the production of the combustible gas and 600 BTU/scf in its liquefaction.

On the other side, the production of the combustible gas at 30 atm, e.g., from animal liquid waste as feedstock, requires about 80 W/scf=273 BTU/scf when an AC-DC converter is used, and about 60 W/scf=205 BTU/scf of DC electricity at the underliquid arc, since AC-DC converters generally have an efficiency of 75%. By using a turbine DC electric generator with an efficiency of only 30% (namely, only 30% of the original; heat is converted into DC electric current), one can see that the total heat available of 900 BTU/scf can produce electricity at the rate of 270 BTU/scf= 78 W/scf, namely 18 W/scf in excess of the electric energy needed to produce said combustible gas.

By recalling that the catalytic liquefaction does not require any appreciable electricity, one can see from the above data that the process of this invention, not only is self-sustaining, namely, capable of generating all the electricity needed for its own operation, but can actually produce an excess of 30% electricity, which excess can be used for complementary purposes, such as the electrolytic separation of water for the production of hydrogen and oxygen. Therefore, Station 5 additionally includes cables delivering excess DC electricity from a generator in DC mode connected to the electrolytic separation equipment. The resulting H and O gases are transferred to Station 3 through respective lines.

For clarity, it should be recalled that the main catalytic reaction $CO+2(H_2)\rightarrow CH_2+H_2O$ requires 46 Kcal/mole as one can see from the known data: the triple bond of CO is 255 Kcal/mole; the $H_2$ bond is 104.2 Kcal/mole; the CH bond is 98.7 Kcal/mole; and the HO bond is 110 Kcal/mole. However, the creation of the hydrocarbon chains releases large amount of heat. In fact, it is known that one single bond of $CH_2$ releases 82.6 Kcal/mole. Therefore, again for the case of one single methylene bond, we have a positive energy output given by 82.6–46 Kcal/mole=36.6 Kcal/mole, which corresponds to approximately 100 BTU/scf of the original combustible fuel. The very conservative assumption that the resulting MagneFuel contains a minimal average of sic $CH_2$ chains implies the total production in the catalytic liquefaction of 600 BTU/scf as indicated earlier.

It should also be noted that the production of methylene according to the reaction $CO+2(H_2)\rightarrow CH_2+H_2O$ requires one molecule (or mole) of CO and two molecules (or moles) of $H_2$. A small percentage of $H_2$ is produced during the catalytic liquefaction by the secondary reaction $CO+H_2O\rightarrow CO_2+H_2$. However, it is evident that the best efficiency of the catalytic liquefaction is achieved when the combustible gas is constituted by two parts of $H_2$ and one part of CO.

Consider then the case of a combustible gas produced by an electric arc within conventional tap water. In this gas the combustible gas, when interpreted as having a conventional molecular structure, is a mixture of 50% $H_2$ and 50% CO. As such, this gas is not suitable to optimize the efficiency of the catalytic liquefaction and must be integrated with $H_2$ as additive, as indicated in Station 3. It should be noted, however, that there is no necessary need for such $H_2$ additive when using other liquids as feedstock which are rich in H content, such as antifreeze waste.

FIG. 1 depicts the particular magnetic bonds North-South in the "polymerization of MagneFuel."

FIG. 2. depicts a typical catalytic liquefaction tower.

Figure 3:
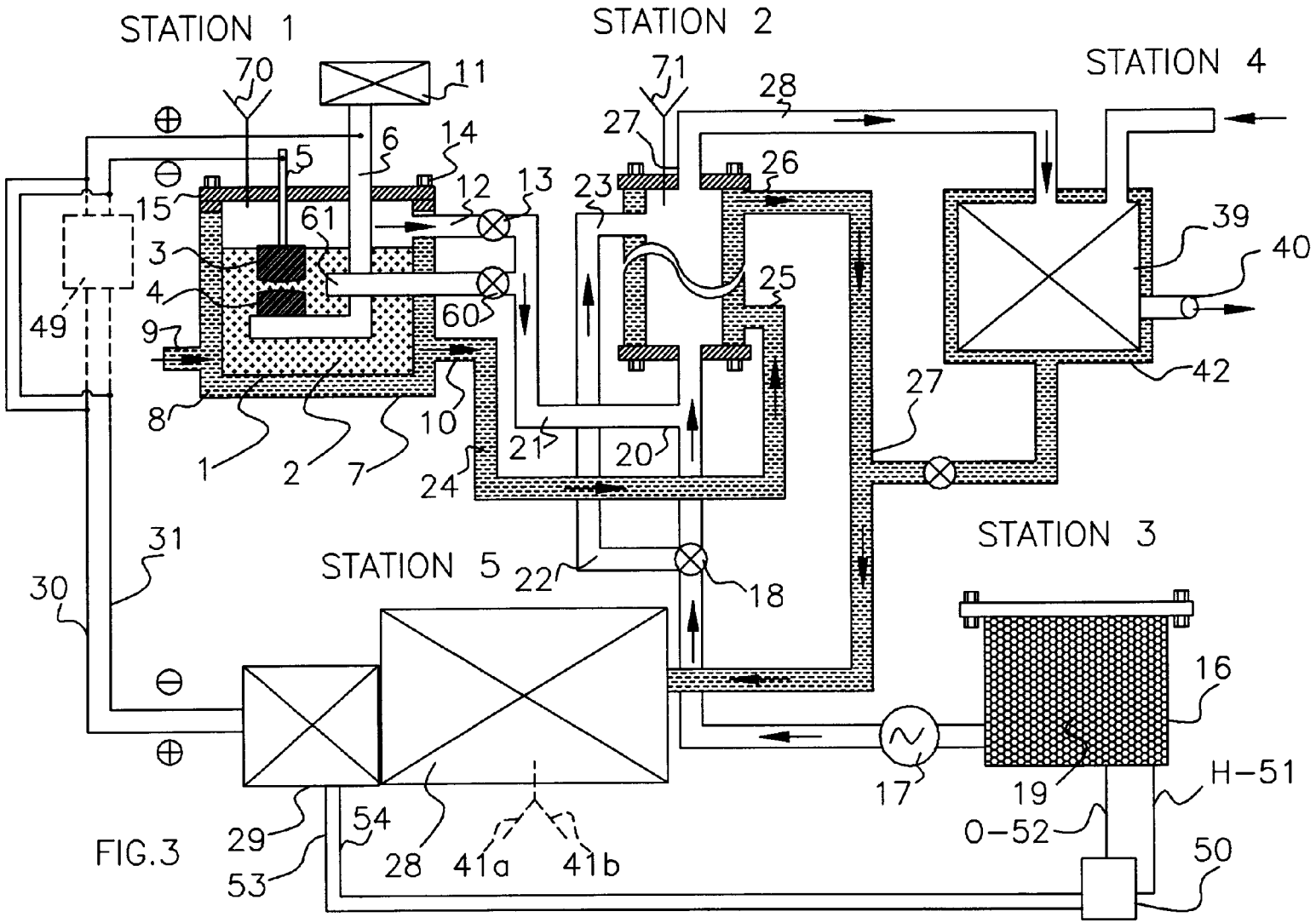

FIG. 3 provides a schematic view of the complete invention.

The invention deals with a new self-sustaining method for the production of a clean burning liquid fuel plus heat from a liquid feedstock comprising:

providing a pressure resistant vessel containing a liquid feedstock, the vessel housing a submerged electric arc between carbon-base electrodes;

activating the submerged electric arc between said carbon base electrodes to produce a combustible gas which bubbles to a surface of the liquid feedstock transmitting said combustible gas via high pressure pipes into a tower for a catalytic processing into a clean burning liquid fuel;

complementing said catalytic process with the addition of natural elements missing in the original liquid feedstock as needed to reach a desired composition of said clean burning liquid fuel;

further processing said clean burning liquid fuel by cryogenic cooling to ambient temperature, separation and filtration, removal of polluting substances, and adding additives to increase octanes, energy content and oxygen output in combustion; and providing means to recover and use a heat produced by the thermochemical reactions for the production of said combustible gas and a heat produced by the liquefaction of said clean burning liquid fuel, wherein said combustible gas has a structure of gaseous electromagnecules consisting of clusters of isolated atoms, dimers and ordinary molecules under internal attractive forces originating from electric and magnetic polarizations of the orbitals of peripheral atomic electrons, wherein said clean burning liquid fuel has a of liquid electromagnecules consisting of clusters of H, C and O atoms, dimers of OH, CH and CO in single or double valence bonds, and ordinary molecules $CH_2$, plus traces of CO in triple valence bond, $H_2$, $O_2$ and other molecules, under internal attractive forces originating from electric and magnetic polarizations of the orbitals of peripheral atomic electrons, so as to prevent the formation of $CH_2$ hydrocarbon chains while preserving similar energy content with consequential improved environmental quality of a combustion exhaust, wherein the heat produced by the thermochemical reactions for the production of said combustible gas and the heat produced by the liquefaction of said clean burning liquid fuel are more than sufficient for the production of steam suitable to power a turbine electric generator for the self-generation of electricity needed to operate the submerged electric arc, and wherein the liquid feedstock is one of crude oil, oil-base waster, and water-base waste.

The above method further comprises said submerged electric arc being powered by a DC electric current produced by said electric generator. The underliquid arc may also be powered by an AC current produced by said electric generator, or by a DC electric current produced by an AC-DC rectifier, the AC-DC rectifier in turn being powered by said electric generator in AC mode.

The DC electricity produced by the electric generator in excess to that needed to power the submerged electric arc is used for an electrolytic separation of water into hydrogen and oxygen gases. Oxygen gas can be fed into the catalytic process to enrich an oxygen content of said clean burning liquid fuel. Hydrogen gas can be fed into the catalytic process to enrich a hydrogen content of said clean burning liquid fuel.

The AC current produced by the electric generator in excess to that needed to operate the submerged electric arc is available for other uses.

The electric generator, typically a turbine powered electric generator, can be partially fueled by the combustible gas or the clean burning liquid fuel.

The coolant used to cool said liquid feedstock and the catalytic process is preferably fresh water, but may be seawater.

The steam produced by the turbine can be cooled and filtered to produce drinking water. Salt precipitates are periodically removed for collection and use.

All clean burning liquid fuel produced and all heat produced are available for use to power the electric generator for the sole production of usable electricity in excess to that needed for operation.

Additional heat is produced by the re-circulation of the combustible gas through the submerged electric arc. Means to recover and use a heat produced by the cryogenic cooling of the clean burning liquid fuel is also provided. Additional heat can be obtained by adding chemical elements in the liquid feedstock suitable to create an exothermal reaction with the liquid feedstock. Additional heat can also be obtained by adding chemical elements in the catalytic process suitable to cause an external reaction with one of the combustible gas, the clean burning liquid fuel and combinations thereof.

The combustion of the clean burning liquid fuel requires less atmospheric oxygen than that needed for gasoline combustion and, in fact, does not require atmospheric oxygen. Further, the combustion of the clean burning liquid fuel does not release carcinogenic or toxic substance to the atmosphere. In fact, the combustion of the clean burning liquid fuel releases less carbon dioxide than that released by gasoline combustion.

A preferred embodiment of this invention comprises the following five stations:

STATION 1: GAS PRODUCTION. With reference to FIG. 3, this station comprises a pressure vessel 1 consisting of a metal cylinder of approximately ¼" wall thickness, 2' outside diameter and 3' outside height filled up with crude oil, or a water-base or oil-base liquid waste as feedstock 2. Carbon-base cylindrical electrodes 3,4 of about 6" and 6" length are immersed within said liquid and are supported by 3" copper rods 5,6, respectively, in the shape of the figure which protrude out of vessel 1 via conventional seals and bushings not shown in the figure for simplicity. Vessel 1 is surrounded in its cylindrical and lower surface by a second pressure metal vessel 7 in the same cylindrical shape and same wall thickness of approximately ¼", yet such to leave everywhere an interspace of about 2" with respect to vessel 1, which space is filled up with tap water or seawater 8 with inlet 9 and outlet 10, said water being used to cool-down the internal vessel 1. Automatic means 11 initiates and maintains the submerged electric arc between electrodes 3, 4. The submerged electric arc first decomposes the liquid molecules into atoms and then ionizes the latter. The electric arc also vaporizes the carbon of the electrodes, by forming a plasma of mostly ionized atoms at about 10,000 degrees C. The plasma cools down in the surrounding liquid, at which point various thermochemical reactions take place, by producing in this way a combustible gas. The latter has an electromagnecular structure because said atoms are exposed to the extremely intense electric and magnetic fields at atomic distances from the electric current, which fields are of the order of billions of Coulomb and Gauss. The latter fields polarize the distribution of the orbits of peripheral atomic electrons from their generally spacial distribution to a toroidal distribution discussed in detail in the above quoted monograph by this inventor (see in particular Appendix 8A). The transition from a spacial to a toroidal distribution then creates a new magnetic field which is sufficiently strong to be the origin of a new chemical species. The magnetic polarization is completed by corresponding electric polarizations also due to the extremely intense electric fields at orbital distances from the electric current, resulting in this way in a combustible gas with electromagnecular structure which occurs for all gases produced via an underliquid discharge. The produced combustible gas then bubbles to the surface of the liquid waste and exits vessel 1 through outlet 12. An adjustable back-pressure regulator 13 is set at the operating pressure of the catalytic tower of Station 2, which is generally of the order of 30 atm. Therefore, the combustible gas is released by Station 1 at the operating pressure of Station 2, without any need for pumps. Station 1 is completed by bolts 14, or other locking mechanisms, which fasten lid 15 to a corresponding ring-shaped base welded as an integral part of vessel 1, which ring is of about 2" in thickness and has the same outside diameter of lid 15. Additional heat can be produced by recirculating part of the combustible gas produced through the electric arc between submerged electrodes 3,4 wherein the combustible gas is diverted through valve 60 and outlet 61 near the occurrence of the electric arc so as to ensure that the combustible gas flows through the electric arc. This recirculation causes the formation of additional $H_2$, CO and $CO_2$ with consequential additional release of heat. Additional heat can be obtained by adding chemical elements at 70 in Station 1 so as to have an exothermic reaction with the liquid feedstock. Additional heat can also be obtained by adding chemical elements to Station 2 at 71 so as to have an exothermic reaction with one of a combustible gas, the clean burning liquid fuel and a combination thereof.

STATION 2: CATALYTIC TOWER. With reference to FIGS. 2 and 3, the catalytic liquefaction tower comprises a pressure metal tower 201 of about ¼" in thickness, 2" in internal diameter and 10' in height with rounded-up top and bottoms as shown in the figure to withstand pressure. Tower 201 is surrounded by an external vessel 202 in the same wall thickness and shape as tower 201, yet such to leave everywhere 2" of interspace 203 which is filled up with coolant 8 coming from Station 1 via high pressure pipes 24 with inlet 25 and outlet 26. Inner space 203 and related coolant 8 is connected to high pressure metal serpentine 204 of ¼" wall thickness, 1" internal diameter and a total of 70' in length located proximate the interior wall of tower 201 so as to permit coolant 8 to pass in the outside as well as in the inside of tower 201. The interior of tower 201 is filled up with catalysts 205 generally consisting of the elements Ni, MgO, ThO, KO reduced to a slurry form composed of fine particles. Alternative catalysts which may be used depending on the desired final liquid fuel are: Co, MgO; Co, ThO; Co, KO; Co, MgO; Fe, MgO, ThO, KO; and Pd, MgO, ThO, KO. The catalyst support is $SiO_2$ (silica), $TiO_2$ (titania), or $Al_2O_3$ (aluminia). The catalyst concentration varies from 20 to 35 percentage in volume. For promoter, it is recommendable to use Cu, Mn, Cr, K, Sc, Mo, W, Ru, Ti, Re, Th (oxides). The slurry is generally kept between a lower grille 206 and an upper grille 207. The slurry must be moved periodically to maintain the efficiency constant. This is achieved via a system of 10 metal blades 208 of about ¼" thickness and length such to reach the internal edge of the serpentine coil 204 yet have sufficient clearance to rotate, said blades 208 being supported by metal shaft 209 of 1" diameter and 9' in length supported at both ends by heat and pressure resistant ball bearings not shown in the figure for simplicity. The entire system of blades 208 and shaft 209 is made to rotate at one revolution per hour by external electric motor 210. The operation of this catalytic liquefaction tower is the following. The combustible gas with electromagnecular structure originating from Station 1 is sent into tower 201 via thermally insulated high pressure pipes 21 at the operating pressure of 30 atm. The gas bubbles upward through tower 201, thus being exposed to said catalysts. The latter exposure causes the main thermochemical reaction consisting of $CO+H_2 \rightarrow CH_2+H_2O$ with the release of the large amount of heat indicated earlier, as well as the side reaction $CO+H_2O \rightarrow CO_2+H_2$ and the release of additional heat. The operating temperature of the tower is of the order of 240 degrees C., thus causing the liquid fuel to remain at the vapor state which, as such, keeps bubbling to the top of the tower, to exit via outlet 27.

STATION 3: ADDITIVES. With reference to FIG. 3, this station comprises: a pressure metal vessel 16 of ½" in thickness, in the cylindrical shape of 1' in outside diameter and 3' in outside height filled up with additive 19 either in gaseous or liquid form as needed by the specific application; a pump 17; a three-way valve 18 in which the first position is that of shut-off, the second position is that of connecting pressure vessel 16 to the junction 20 of the combustible gas outlet pipe 21, and the third position is that of connection vessel 16 via pipes and inlet 23 to the top 23 of the catalytic tower of Station 2. When the selected liquid waste is such not to require additives, valve 18 is shut-off. When a gaseous additive 19 is needed for a given waste 2, the gaseous additive is kept in vessel 16 at a pressure equal or greater than the outlet pressure of the combustible gas, namely, 30 atm. In this case pump 17 is disconnected or inoperative and valve 18 is open to release the needed flow of the gaseous additive 19 to the catalytic tower of Station 2 via a conventional pressure regulator not shown in the figure for simplicity. When a liquid additive is needed, valve 18 is put in the position of connecting vessel 16 to pipe 22 and outlet 23. In this case pump 17 is activated to provide the catalytic tower with the needed liquid additive. In this way, the gaseous additive bubbles through tower 201 jointly with the combustible fuel and it is mixed with the latter by rotating blades 208. When the additive is liquid, it enters tower 201 from the top and moves downward via gravity, by also mixing with the combustible gas, thanks to blades 208. Whatever the selected additive, experimentation has established that, as soon as exposed to a gas with electromagnecular structure, the additive also acquires the same structure via electric and magnetic inductions. The catalytic action then completes the achievement of the desired final form of MagneFuel for different versions of the combustible gas.

STATION 4: TREATMENT OF MAGNEFUEL. With reference to FIG. 3, following the catalytic conversion, MagneFuel exits the catalytic tower in a vapor form via outlet 27 and it is sent via high pressure pipe 28 into a treatment station 39 which includes: cryogenic means to liquify MagneFuel; filters to remove particulates in suspension in the liquid; separators, e.g., to remove undesired heavy hydrocarbons; additives, e.g., to increase the BTU content of MagneFuel; and other means not shown in FIG. 3 for simplicity. MagneFuel finally exits from this station via outlet 40 at ambient temperature where it is collected for use as automotive or other fuel. It is evident that the cooling of MagneFuel by Station 4 from a vapor state to ambience temperature implies the release of additional usable heat depending on the final chemical composition of MagneFuel. This heat can be utilized via a heat exchanger 42 and added to the preceding two sources of heat via thermally insulated high pressure pipes and other simple means not necessarily shown in FIG. 3 for simplicity.

STATION 5: SELF-GENERATION OF ELECTRICITY. With reference to FIG. 3, tap water or seawater 8 at ambient temperature is first used to cool-down vessel 1 of Station 1, by adjusting the flow to maintain the latter at the constant operating temperature of 120 degrees C. After exiting from outlet 10, coolant 8 is then passed through pipe 24 to enter the lower part of catalytic tower via inlet 25 and then to exit from the latter via outlet 26, by keeping the catalytic tower at the constant temperature of 240 degrees C., and by reaching in this way the state of steam suitable to power a turbine. The third source of hear is that from the cooling of Station 4, which is added to the preceding two sources of heat via exchangers 42 known in the art. The steam is then transferred via high pressure pipe 27 into a conventional turbine 28 which powers the DC electric generator 29. The current so produced is then used to power the underliquid electric arc between electrodes 3,4 via cables 30,31. The excess electricity produced by the station is diverted into other uses, such as the electrolytic separation of water, via a conventional control panel not shown in FIG. 3 for simplicity. In the event seawater is used as coolant 8, the outlet vapors of turbine 28 are condensed, filtered and duly processed to produce drinking water 41*a,* with salt 41*b* being precipitated out. As previously discussed above, the catalytic liquefaction does not require any appreciable electricity. One can see from the above data that the process of this invention, not only is self-sustaining, namely, capable of generating all the electricity needed for its own operation, but can actually produce an excess of about 30% electricity, which excess can be used for complementary purposes, such as the electrolytic separation of water for the production of hydrogen and oxygen. Therefore, Station 3 additionally includes cables 53,54 delivering excess DC electricity from generator 29 in DC mode connected to the electrolytic separation equipment 50. The resulting H and O gases are transferred to Station 5 through lines 51, 52 respectively.

PRODUCTION DATA. With reference again to FIG. 3, Station 1 requires a DC electric current with 180 Kwh which is capable of producing about 2,500 scf/h of combustible gas which, assuming a conservative average of 700 BTU/scf, correspond to an average of 1,750,000 BTU/h of gaseous fuel plus about 750,000 BTU/h of heat. When subjected to catalytic liquefaction in Station 2, the production of 2,500 scf/h of gaseous fuel is transformed into a volume of MagneFuel which, when at the liquid state, is of about 3 g/h. Assuming that MagneFuel has an average of 110,000 BTU/g, the original 1,750,000 BTU/h of combustible gas are reduced to about 330,000 BTU/h of MagneFuel, the balance of about 1,420,000 BTU being released as heat. The total energy output of the preferred equipment herein considered is therefore given by about 330,000 BTU/h of liquid MagneFuel plus about 2,500,000 BTU/h of heat originating from three sources, Stations 1, 2 and 4. By assuming an efficiency of 30% in the conversion of heat into electricity via a turbine operated DC electric generator, the method herein considered can produce about 192 Kwh, namely, an amount of DC electricity bigger than the 180 Kwh needed for its operation, thus confirming that the process of this invention is self-sustaining in the sense that it can indeed generate the electricity needed for its own operation. It should be indicated that said total production of heat of about 2,500,000 BTU/h can be increased in a variety of ways, thus resulting in the production of additional electricity. For instance, the combustible gas can be re-circulated through the electric arc before being released to the catalytic liquefaction tower. This recirculation evidently increases the number of C and O atoms into the triple bond of CO, with additional release of heat. Similarly various substances can be added to the feedstock whose thermochemical reactions produce additional usable heat. Along similar lines, a number of additives can be introduced in the catalytic liquefaction process such to produce additional heat via thermochemical reactions. Needless to say, particularly when the latter excess heat is obtained, this invention can use a turbine operated AC electric generator, in which case the production of the combustible gas can be powered by a conventional AC-DC converter (rectifier) 49. In particular, the electric arc can also be powered by an AC, rather than a DC electric current, in which case the AC generator is the power of Station 1. The advantage of the latter setting is the production of excess AC current which can be released into the grid. At the extreme, the entire liquid fuel produced and the entire heat produced can be used to power an AC generator, in which case this invention provides a primary clean source of electric energy without any damage to the environment, and with the actual elimination of unwanted liquid wastes.

Now that the invention has been described,

What is claimed is:

1. A method for the production of a clean burning liquid fuel plus heat from a liquid feedstock comprising:

providing a pressure resistant vessel containing a liquid feedstock, the vessel housing a submerged electric arc between carbon-base electrodes;

activating the submerged electric arc between said carbon base electrodes to produce, by thermochemical reactions, a combustible gas which bubbles to a surface of the liquid feedstock, and transmitting said combustible gas via high pressure pipes into a tower for a catalytic liquefaction processing into a clean burning liquid fuel;

complementing said catalytic process with the addition of chemical material missing in the original liquid feedstock to reach a desired composition of said clean burning liquid fuel;

further processing said clean burning liquid fuel by cryogenic cooling to ambient temperature, separation and filtration, removal of polluting substances, and adding additives to increase octane, energy content and oxygen output in combustion; and providing means to recover and use a heat produced by the thermochemical reactions for the production of said combustible gas, a heat produced by the liquefaction into said clean burning liquid fuel and a heat produced by the cryogenic cooling of the clean burning liquid fuel, wherein the heat produced by the thermochemical reactions for the production of said combustible gas, the heat produced by the liquefaction into said clean burning liquid fuel, the heat produced by the cryogenic cooling of the clean burning liquid fuel, and additional heat obtained by adding said chemical material to the catalytic process suitable to cause an external reaction with one of the combustible gas, the clean burning liquid fuel and combinations thereof are more than sufficient for the production of steam suitable to power a turbine electric generator for the generation of electricity needed to operate the submerged electric arc, and wherein the liquid feedstock is one of crude oil, oil-base waste, and water-base waste.

2. The method according to claim 1, wherein said submerged electric arc is powered by a DC electric current produced by said electric generator.

3. The method according to claim 1, wherein said submerged electric arc is powered by an AC current produced by said electric generator.

4. The method according to claim 1, wherein said submerged electric arc is powered by a DC electric current produced by an AC-DC rectifier, the AC-DC rectifier in turn being powered by said electric generator in AC mode.

5. The method according to claim 2, wherein the DC electricity produced by said electric generator in excess to that needed to power the submerged electric arc is used for an electrolytic separation of water into hydrogen and oxygen gases.

6. The method according to claim 5, wherein said oxygen gas is fed into said catalytic process to enrich an oxygen content of said clean burning liquid fuel.

7. The method according to claim 5, wherein said hydrogen gas is fed into the catalytic process to enrich a hydrogen content of said clean burning liquid fuel.

8. The method according to claim 3, wherein the AC current produced by said electric generator in excess to that needed to operate the submerged electric arc is available for uses.

9. The method according to claim 1, wherein said turbine powered electric generator is partially fueled by said combustible gas.

10. The method as per claim 1, wherein said turbine powered electric generator is partially fueled by said clean burning liquid fuel.

11. The method according to claim 1, wherein coolant used to cool said liquid feedstock and said catalytic process is fresh water.

12. The method according to claim 1, wherein coolant used to cool said liquid feedstock and said catalytic process is seawater.

13. The method according to claim 12, wherein the steam produced by said turbine is cooled and filtered to produce drinking water.

14. The method according to claim 12, wherein salt precipitates are periodically removed for collection and use.

15. The method according to claim 1, wherein all clean burning liquid fuel produced and all heat produced are used to power the electric generator for the sole production of usable electricity in excess to that needed for the electric generator's operation.

16. The method according to claim 1, wherein additional heat is produced via re-circulation of said combustible gas through the submerged electric arc.

17. The method according to claim 1, wherein additional heat is obtained by adding a chemical material in the liquid feedstock suitable to create an exothermal reaction with the liquid feedstock.

18. The method according to claim 6, wherein the combustion of said clean burning liquid fuel requires less atmospheric oxygen than that needed for gasoline combustion.

19. The method according to claim 6, wherein the combustion of said clean burning liquid fuel does not require atmospheric oxygen.

20. The method according to claim 1, wherein the combustion of said clean burning liquid fuel does not release carcinogenic or toxic substance.

21. The method according to claim 1, wherein the combustion of said clean burning liquid fuel releases less carbon dioxide than that released by gasoline combustion.

* * * * *